US011011848B2

(12) United States Patent
Mancewicz et al.

(10) Patent No.: US 11,011,848 B2
(45) **Date of Patent: *May 18, 2021**

(54) QUAD-TAPERED SLOT ANTENNA WITH THINNED BLADES

(71) Applicant: The United States of America, as represented by the Secretary of the Navy, San Diego, CA (US)

(72) Inventors: Steven Edward Mancewicz, San Diego, CA (US); David Walker Brock, San Diego, CA (US); Robert Joseph Motyl, Oceanside, CA (US)

(73) Assignee: United States of America as represented by the Secretary of the Navy, Washington, DC (US)

( * ) Notice: Subject to any disclaimer, the term of this patent is extended or adjusted under 35 U.S.C. 154(b) by 204 days.

This patent is subject to a terminal disclaimer.

(21) Appl. No.: 16/437,114

(22) Filed: Jun. 11, 2019

(65) Prior Publication Data

US 2020/0395670 A1 Dec. 17, 2020

(51) Int. Cl.
*H01Q 13/08* (2006.01)
*H01Q 25/00* (2006.01)

(52) U.S. Cl.
CPC ..... *H01Q 13/085* (2013.01); *H01Q 25/001* (2013.01)

(58) Field of Classification Search
CPC ..... H01Q 13/085; H01C 25/002
See application file for complete search history.

(56) References Cited

U.S. PATENT DOCUMENTS

| | | | | |
|---|---|---|---|---|
| 3,013,226 | A | 12/1961 | Du Hamel et al. | |
| 4,132,993 | A | 1/1979 | Ehrhardt et al. | |
| 6,219,000 | B1 * | 4/2001 | McWhirter | H01Q 13/085 343/767 |
| 7,009,572 | B1 | 3/2006 | Homer | |
| 8,736,504 | B1 * | 5/2014 | West | H01Q 25/001 343/767 |

(Continued)

OTHER PUBLICATIONS

Jingjian et al.; Suppression of Cross-Polarization of the Microstrip Integrated Balun-Fed Printed Dipole Antenna; International Journal of Antennas and Propagation; Published Apr. 1, 2014; Hindawi Publishing Corporation.

(Continued)

*Primary Examiner* — Daniel Munoz
(74) *Attorney, Agent, or Firm* — Naval Information Warfare Center, Pacific; Kyle Eppele; J. Eric Anderson

(57) ABSTRACT

A dual-polarized tapered slot antenna (TSA) comprising: a dielectric bracket; a first pair of conductive blades mounted to the dielectric bracket so as to define a first tapered slot between edges of the conductive blades of the first pair thereby forming a horizontally-polarized TSA; a second pair of conductive blades mounted in the dielectric bracket orthogonal to the first pair so as to define a second tapered slot between edges of the conductive blades of the second pair thereby forming a vertically-polarized TSA; and wherein at least part of each of the slot-defining edges of the conductive blades has a thickness that is non-tapered and stepwise-reduced from the thickness of a remainder of the corresponding blade.

20 Claims, 7 Drawing Sheets

(56) References Cited

U.S. PATENT DOCUMENTS

| | | | | |
|---|---|---|---|---|
| 9,306,289 | B1 | 4/2016 | Bermeo et al. | |
| 2019/0252787 | A1* | 8/2019 | McGrath ..... | H01Q 21/064 |

OTHER PUBLICATIONS

Duncan, J. W., Minerva, V. P.; 100:1 Bandwidth Balun Transformer; Proceedings of the IRE; Feb. 1960.

Hees et al.; Characteristics of a Corrugated Tapered Slot Antenna with Dielectric Rod and Metallic Reflector; Proceedings of the 2008 IEEE International Conference on Ultra-Wideband (ICUWB2008), vol. 1; 2008.

Adamiuk et al.: Dual-orthogonal polarized Vivaldi Antenna for Ultra Wideband Applications; 17th International Conference on Microwaves, Radar and Wireless Communications; 2008.

ETS-Lingren; Open Boundary Quad-Ridged Horns, User Manual; 2007.

Kenyon, Christopher S.; Evaluation of the ETS-Lindgren Open Boundary Quad-Ridged Horn 3164-06; Army Research Laboratory—Technical Report 7272; Apr. 2015.

* cited by examiner

QUAD-TAPERED SLOT ANTENNA WITH THINNED BLADES

FEDERALLY-SPONSORED RESEARCH AND DEVELOPMENT

The United States Government has ownership rights in this invention. Licensing and technical inquiries may be directed to the Office of Research and Technical Applications, Naval Information Warfare Center Pacific, Code 72120, San Diego, Calif., 92152; voice (619) 553-5118; ssc_pac_t2@navy.mil. Reference Navy Case Number 109882.

BACKGROUND OF THE INVENTION

There is a need for a broadband, high power handling, dual polarized, directional antenna. Some prior art solutions have attempted to address this need by using multiple narrower band antennas to cover the same frequency range, or by using multiple single polarization antennas. However, a multiple-antenna approach can be costly and physically large. At least one attempt has been made to address these drawbacks with a single reflector antenna with a crossed (quad) tapered slot antenna with chamfered/tapered blade edges, but this attempt yielded unsatisfactory performance.

SUMMARY

Disclosed herein is a dual-polarized tapered slot antenna (TSA) comprising a dielectric bracket and first and second pairs of conductive blades. The first pair of conductive blades is mounted to the dielectric bracket so as to define a first tapered slot between edges of the conductive blades of the first pair thereby forming a horizontally-polarized TSA. The second pair of conductive blades is mounted in the dielectric bracket orthogonal to the first pair so as to define a second tapered slot between edges of the conductive blades of the second pair thereby forming a vertically-polarized TSA. At least part of each of the slot-defining edges of the conductive blades has a thickness that is non-tapered and stepwise-reduced from the thickness of a remainder of the corresponding blade.

An embodiment of the dual-polarized TSA may also be described as comprising a non-conductive bracket and first, second, third, and fourth antenna elements. The first and second antenna elements are mounted to the bracket so as to define a first tapered slot between edges of the first and second antenna elements thereby forming a horizontally-polarized TSA. The third and fourth antenna elements are mounted to the bracket so as to define a second tapered slot between edges of the third and fourth antenna elements thereby forming a vertically-polarized TSA. Each of the antenna elements comprises a step-wise-reduced-thickness section as compared to a thickness of a remainder of the corresponding antenna element. A terminal edge of the step-wise-reduced-thickness section composes a portion of a corresponding antenna element's slot-defining edge.

BRIEF DESCRIPTION OF THE DRAWINGS

Throughout the several views, like elements are referenced using like references. The elements in the figures are not drawn to scale and some dimensions are exaggerated for clarity.

DETAILED DESCRIPTION OF EMBODIMENTS

The disclosed antennas below may be described generally, as well as in terms of specific examples and/or specific embodiments. For instances where references are made to detailed examples and/or embodiments, it should be appreciated that any of the underlying principles described are not to be limited to a single embodiment, but may be expanded for use with any of the other methods and systems described herein as will be understood by one of ordinary skill in the art unless otherwise stated specifically.

Figure 1A:
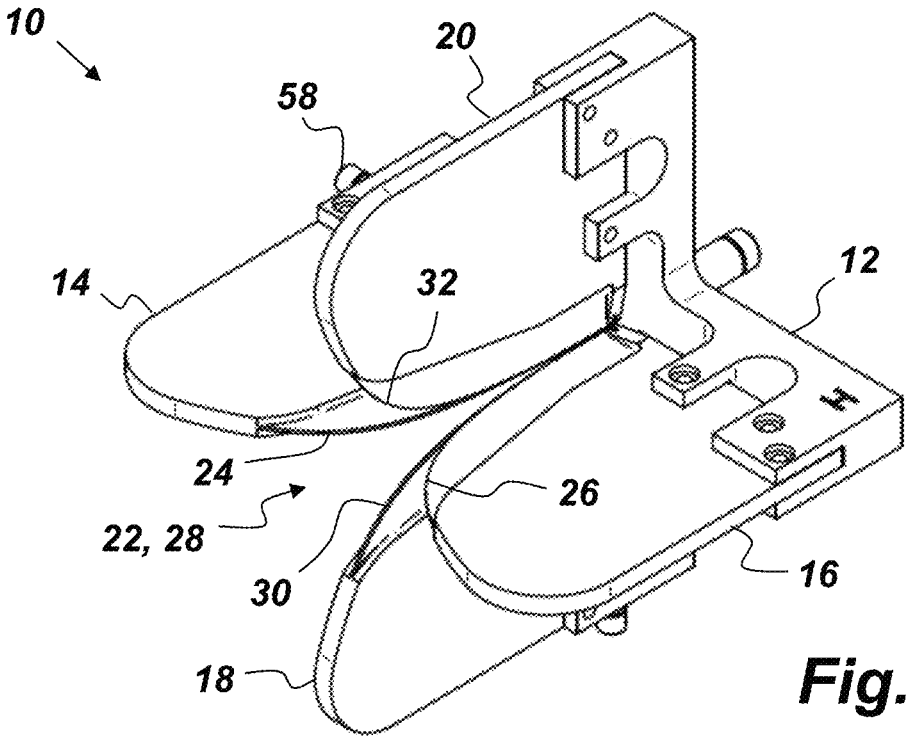
FIGS. 1A and 1B are perspective and top views respectively of an embodiment of a dual-polarized tapered slot antenna.
Figure 1B:
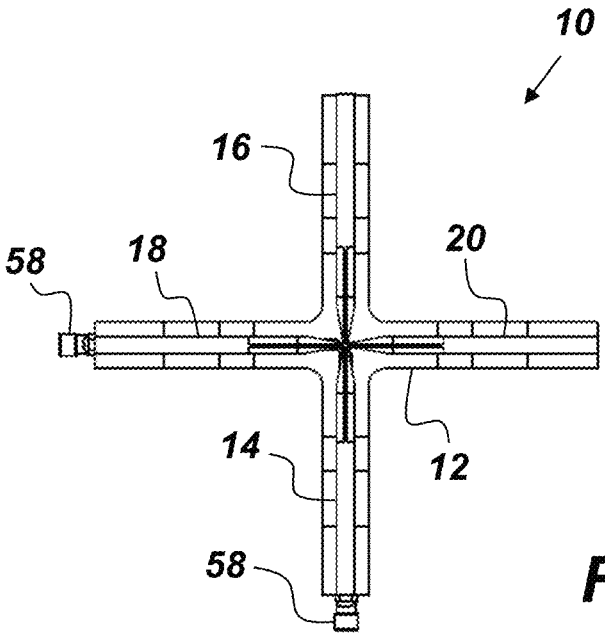

FIGS. 1A and 1B are perspective and top views respectively of a dual-polarized TSA 10 that comprises, consists of, or consists essentially of a dielectric bracket 12 and first, second, third, and fourth antenna elements 14, 16, 18 and 20 respectively. The first and second antenna elements 14 and 16 are mounted to the bracket 12 and respectively comprise radiating edges 24 and 26 that are positioned with respect to each other so as to define a first tapered slot 22 between the radiating edges 24 and 26 thereby forming a horizontally-polarized TSA. The third and fourth antenna elements 18 and 20 are mounted to the bracket 12 and respectively comprise radiating edges 30 and 32 that are positioned with respect to each other so as to define a second tapered slot 28 between the radiating edges 30 and 32 thereby forming a vertically-polarized TSA. The dielectric bracket 12 may be constructed of any desired dielectric material. In one suitable example, the dielectric bracket 12 is made of polyoxymethylene.

In the embodiment of the dual-polarized TSA 10 shown in FIGS. 1A and 1B, a majority of the radiating/slot-defining edges 24, 26, 30, and 32 has a thickness that is non-tapered and stepwise-reduced from the thickness of a remainder of the corresponding blade. In one embodiment of the dual-polarized TSA 10, a portion of the non-tapered and stepwise-reduced section of each of the antenna elements 14, 16, 18, and 20 remains non-tapered and stepwise-reduced for a least 12 millimeters (0.49 inches) as measured perpendicularly from the corresponding radiating/slot-defining edges 24, 26, 30, and 32. A suitable example of material from which the first, second, third, and fourth antenna elements 14, 16 18, and 20 may be made is, but is not limited to, aluminum. The first and third antenna elements 14 and 18 are configured to be electrically connected to outer conductors of separate coaxial cables (not shown). The second and fourth antenna elements 16 and 20 are configured to be electrically connected to the inner conductors of separate coaxial cables.

Figure 2A:
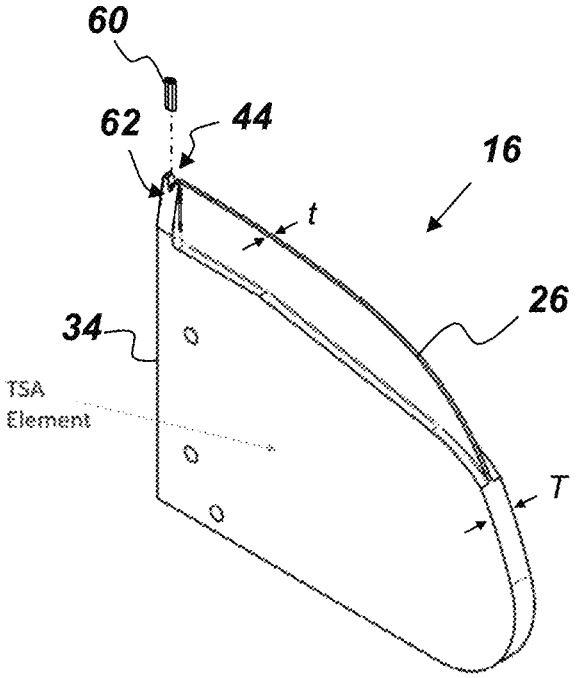
FIG. 2A is a perspective view of a blade of a dual-polarized, quad tapered slot antenna.

FIG. 2A is a perspective view of the second antenna element, or blade, 16 of the dual-polarized, quad TSA antenna 10 shown in FIGS. 1A and 2A. As is shown with respect to the second antenna element 16 in FIG. 2A, each of the antenna elements (i.e., 14, 16, 18, and 20) comprises a thinned-edge portion that has a thickness t that is non-tapered and stepwise-reduced from the thickness T of a non-thinned portion of the corresponding blade. For example, in one embodiment, t is 0.762 millimeters (0.03 inches) and T is 4.826 millimeters (0.19 inches). In one embodiment, the tapered slots 22 and 28 have a narrowest dimension that is approximately 0.6 of the thickness t of the thinned edge portions of the antenna elements 14, 16, 18, and 20. The step-wise-reduced-thickness sections compose a portion of each of the radiating/slot-defining edges 24, 26, 30, and 32.

Figure 2B:
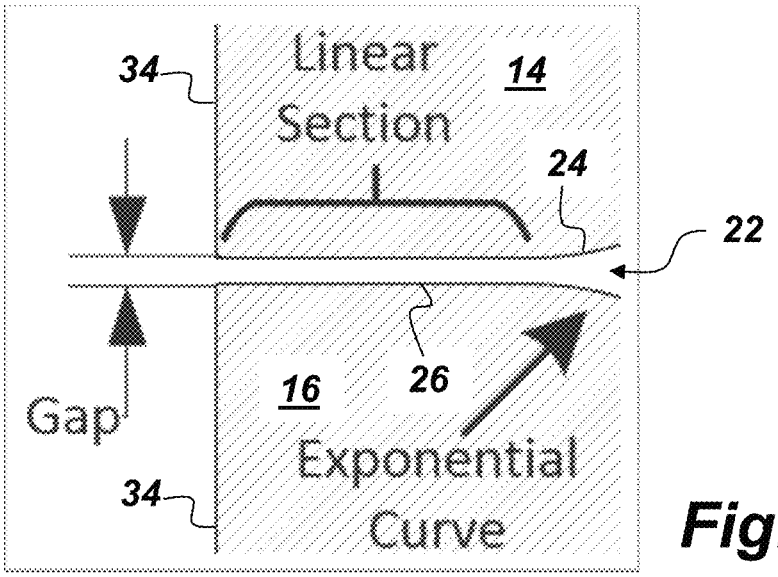
FIG. 2B is a close-up, cross-sectional view of an embodiment of a horizontally polarized tapered slot antenna.

FIG. 2B is a close-up, cross-sectional view of an embodiment of a horizontally polarized TSA where each of the radiating edges 24 and 26, which together define the first tapered slot 22, comprises a linear section that transitions to an exponentially-curved section. The linear section of each of the radiating edges 24 and 26 is disposed near a bottom edge 34 of each of each of the first and second antenna elements 14 and 16. The dual-polarized TSA 10 is typically fed from near the bottom edge 34. In one embodiment of the dual-polarized TSA 10, the linear sections of the radiating/slot-defining edges 24 and 26 are within one degree of being parallel with each other such that a narrowest part of the first tapered slot 22 is closest to the bottom edge 34. Likewise, with respect to the radiating/slot-defining edges 30 and 32, in one embodiment, their linear sections are within one degree of being parallel with each other such that a narrowest part of the second tapered slot 28 is closest to the bottom edge 34.

Figure 3:
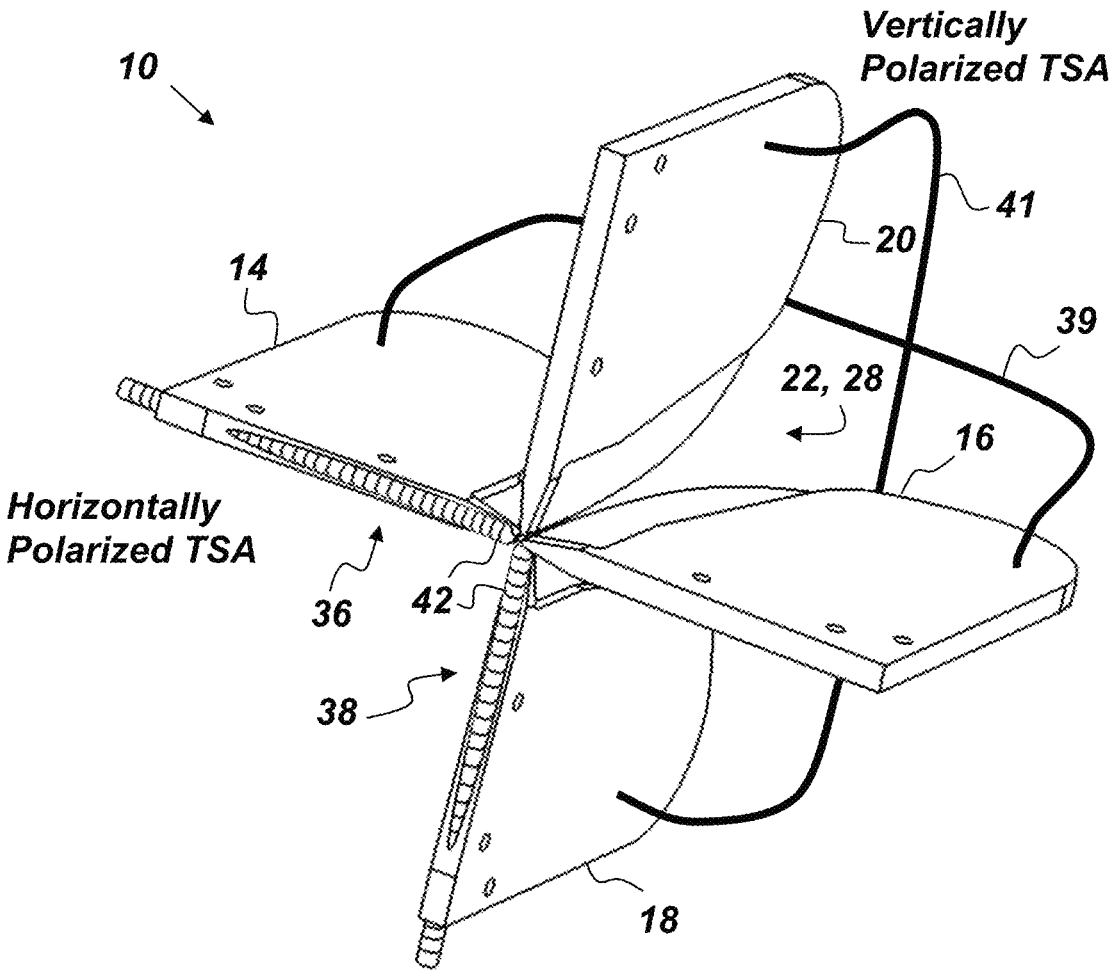
FIG. 3 is a bottom, perspective view of an embodiment of a dual-polarized tapered slot antenna.

FIG. 3 is a bottom, perspective view of an embodiment of the dual-polarized TSA 10 that has first and second coaxial baluns 36 and 38 respectively integrated into the first and third antenna elements 14 and 18. The baluns 36 and 38 enable efficient transition from the unbalanced structure of a coaxial cable (such as would be used to attach the dual-polarized TSA 10 to a transceiver) to the balanced structure of the dual-polarized TSA 10 without causing unwanted reflected energy in the coaxial cable. The integrated baluns 36 and 38 also transform the impedance to a higher resistance. Both of these advantages allow this embodiment of the dual-polarized TSA 10 to handle higher power than similar prior art antennas that lack an integrated balun. Further, the impedance transform allows for matching the impedance of the transmission line/balun and also allows the first and second antenna elements 14 and 16 and the third and fourth antenna elements 18 and 20 to be spaced farther apart than similar prior art antennas that lack integrated, tapered, coaxial baluns. Also shown in FIG. 3 are optional conductive elements 39 and 41. Conductive element 39 is electrically connected to both the first and second antenna elements 14 and 16. Conductive element 41 is electrically connected to both the third and fourth antenna elements 18 and 20. The conductive elements 39 and 41 are positioned so as to respectively span the tapered slots 22 and 28.

Figure 4A:
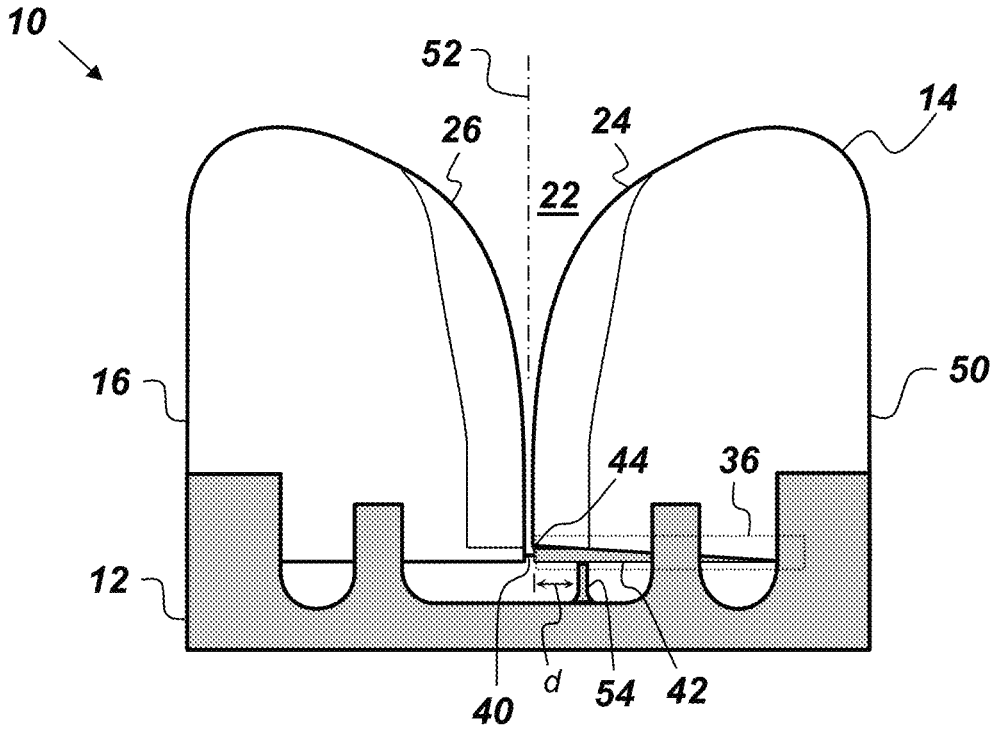
FIG. 4A is a side-view illustration of an embodiment of a horizontally-polarized tapered slot antenna.
Figure 4B:
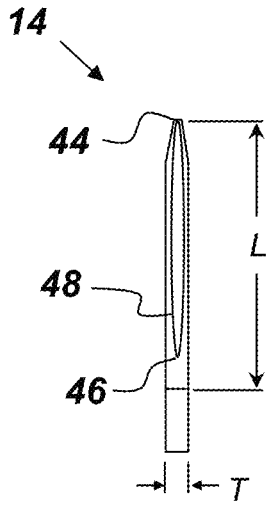
FIGS. 4B and 4C are respectively bottom and side views of an embodiment of a blade of a tapered slot antenna.
Figure 4C:
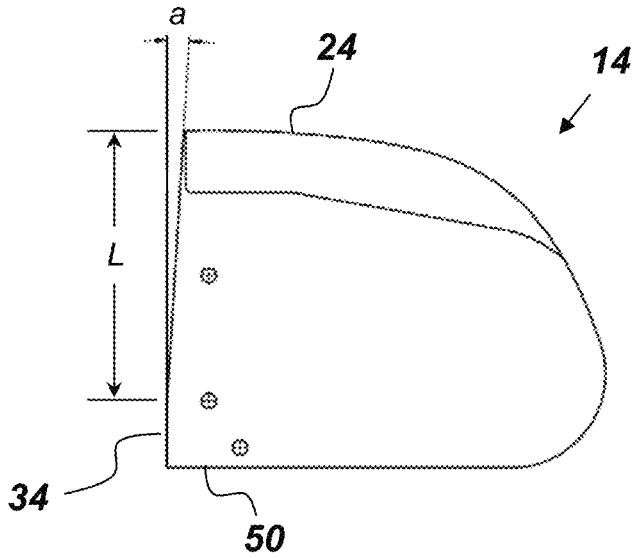

FIG. 4A is a side-view illustration of the horizontally-polarized TSA with the integrated balun 36 from the embodiment of the dual-polarized TSA 10 shown in FIG. 3. FIGS. 4B and 4C are respectively bottom and side views of an embodiment of the first antenna element 14 of the embodiment of the dual-polarized TSA 10 shown in FIG. 4A. Each of the integrated baluns 36 and 38 comprises a center conductor 40 and a dielectric 42. The center conductor 40 is electrically connected to the non-balun-integrated blade of the TSA. For example, in FIG. 4A, the center conductor 40 is electrically connected to the second antenna element 16. The dielectric 42 surrounds the center conductor 40 and is disposed to electrically insulate the center conductor 40 from the first antenna element 14. At a first location 44 on the first antenna element 14, the dielectric 42 abuts the bottom edge 34 of the first antenna element 14. Over a length L of the integrated balun 36, the first antenna element 14 gradually surrounds more and more of the dielectric 42 until, at a second location 46, the dielectric 44 is completely surrounded by the first antenna element 14 so as to gradually transform an unbalanced signal at the second location 46 to a balanced signal that is characteristic of a two-conductor transmission line at the first location 44.

Each of the baluns 36 and 38 has wide bandwidth potential with the lower frequency being limited by the length of the taper (~¼ lambda) and the upper frequency being limited by the higher order modes of the coaxial cable to which it is attached. To achieve a good match to a typical 50Ω coaxial transmission line (Z=50+0i), the air gap (i.e., tapered slot 22 or 28) between a single set of TSA elements, having a thickness of 2.54-5.08 millimeters (0.1-0.2 inches), should be approximately ¼ to ⅕ the thickness of the elements at the narrowest section. For example, if the elements are 3.175 millimeters (0.125 inches) thick, the gap between elements at the narrowest section should be about 0.762 millimeters (0.03 inches). For thinner blades, the ratio between the thickness of the air gap and the blade thickness may be higher. For example, if the blade thickness is 0.762 millimeters (0.03 inches) the ratio between the narrowest part of the air gap and the blade thickness may be approximately 0.6.

Each of the baluns 36 and 38 may be formed by creating a cylindrical hole 48 from a back edge 50 to the radiating edge 24 of the first antenna element 14. Then, the bottom edge 34 of the first antenna element 14 may be cut away at an angle a over the length L. In one embodiment, the length L spans a majority of the length of the bottom edge 34 and the hole 48 is cut away along a downward-angled plane that is not parallel with the hole 48 and that intersects the radiating edge 24 at approximately the top of the hole 48. In one embodiment, the degree to which the first antenna element 14 surrounds the dielectric 42 gradually transitions from the first location 44 near the intersection of the radiating edge 24 and the hole 48 of the first antenna element 14 where the dielectric 42 is in tangential contact with the first antenna element 14 to the second location 46 where the first antenna element 14 completely surrounds the dielectric 42. In one embodiment of the dual-polarized TSA 10, the length L of the cut is approximately 56 millimeters (~2.2 inches) and the angle a is approximately 3.5° such that at the radiating edge 24, approximately 335° of an inner wall of the hole 48 is cut away, which corresponds to an impedance of ~160Ω. In one example embodiment, the hole 48 has a diameter of 3.58 millimeters (0.141 inches). The integrated balun 36 and/or 38 may be optimized for different applications by varying the angle a and length L of the cut.

Also shown in FIG. 4A is a dotted-dashed line 52 which represents a centerline that runs through the middle of the air gap or first tapered slot 22 that separates the first and second radiating edges 24 and 26. The dielectric bracket 12 shown in FIG. 4A comprises an optional, dielectric support structure 54 that is disposed to maintain a positional relationship between the dielectric 42 and the first blade 14 and to counteract deflection of the dielectric 42 and the center conductor 40 due to gravity. In this embodiment, the dielectric 42 is cylindrical and the area of contact between the dielectric support structure 54 and the dielectric 42 does not exceed a circular, cross-sectional area of the dielectric 42. It is to be understood that the dielectric 42 is not limited to cylindrical shapes, but may be any desired shape. The dielectric support structure 54 may be placed a distance d away from the radiating edge 24. In one embodiment, the distance d is at least 1/24 wavelength (at a lowest intended operating frequency of the dual-polarized TSA 10). In one embodiment, the distance d is at least 15 millimeters away from the radiating edge 24.

In some embodiments of the dual-polarized TSA 10, the center conductor 40 and the dielectric 42 may be the dielectric sheath and inner conductor of a semi-ridged coaxial cable. For example, with respect to the TSA embodiment of the dual-polarized TSA 10 shown in FIG. 4A, the outer insulative layer and the outer conductor of a semi-rigid coaxial cable may be removed and the remaining dielectric sheath and inner conductor may be pressed into the hole 48. The outer conductor of the coaxial cable may be electrically connected to the first antenna element 14 and the inner conductor may be electrically connected to the second antenna element 16. Alternatively, the baluns 36 and 38 may each comprise a connector 58 (such as is shown in FIGS. 1A and 1B) for respectively attaching the outer and inner conductors of a coaxial cable to the first or third antenna element 12 or 18 and the center conductor 40.

Still referring to FIG. 4A, this embodiment of the dual-polarized TSA 10 further comprises a retainer 60 configured to hold the center conductor 40 in a receiving hole 61 (such as is shown in FIG. 2A) in the second antenna element 16 so as to maintain electrical connectivity between the center conductor 40 and the second antenna element 16. Another retainer 60 may also be used to hold a second center conductor 40 in a receiving hole in the fourth antenna element 20 so as to maintain electrical connectivity between the second center conductor 40 and the fourth antenna element 20. In one embodiment, the center of the receiving hole 61 in each of the second and fourth antenna elements 16 and 20 is positioned 1.9 mm (0.075 inches) from the bottom edge 34 of the second and fourth antenna elements 16 and 20. Suitable examples of the retainer 60 include, but are not limited to, a spring, a retaining pin, and a set screw. In the embodiment of the second antenna element 16 shown in FIG. 2A, the retainer 60 is an electrically conductive insert that is pressed into the receiving hole 61 and comprises a female feature for receiving, and maintaining electrical contact with, the center conductor 40. Any portions of the retainer 60 that extend beyond the outer surfaces of the second antenna element 16, such as surface 62 shown in FIG. 2A, may be made flush with the second antenna element 16. In some embodiments, the retainer 60 may be disposed in a recess in the second antenna element 16, which recess may be subsequently filled with a conductive substance such as silver epoxy. The conductive substance filling the recess may be smoothed to conform with the outer surfaces of the second antenna element 16, such as the side surface 62 and the radiating edge 26. The smoothing of the conductive substance to conform with the outer surfaces of the second antenna element 16 had an unexpectedly large impact on the performance (specifically reducing the return loss) of a prototype embodiment of the antenna 10.

Embodiments of the dual-polarized TSA 10 may be integrated into a high power broadband transceiver system. The dual-polarized TSA 10 is capable of receiving or transmitting high power radio frequency energy on dual linear polarizations simultaneously (or other single polarizations such linear, right-hand circular, or left-hand circular) over a greater bandwidth than that which is achievable by prior art antennas. Thinning the blade, as depicted in FIG. 1A, did not cause the inductance of the dual-polarized TSA 10 to increase the way a chamfer does and thus is able to provide a good impedance match to typical transmission lines over more broad frequency ranges than the prior art. A better impedance match has the advantage of higher power handling capability and higher overall antenna efficiency.

Figure 5A:
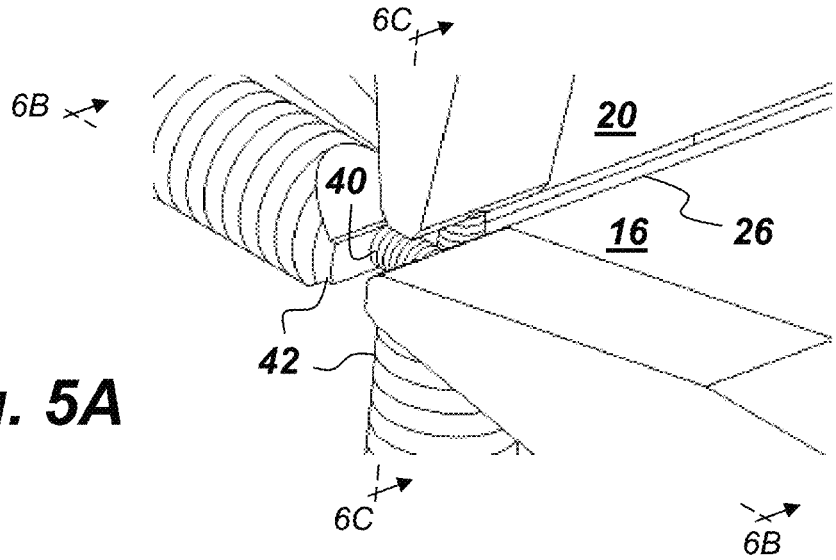
FIG. 5A is a close-up, perspective view of a bottom, center section of an embodiment of a dual-polarized tapered slot antenna.
Figure 5B:
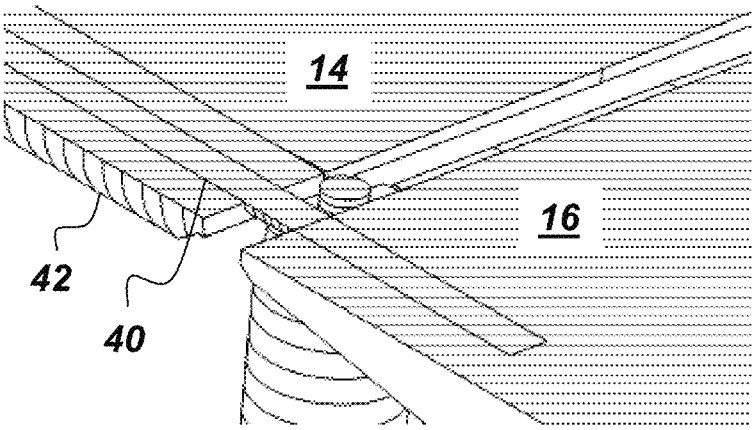
FIGS. 5B and 5C are cross-sectional views of the close-up, perspective view of the bottom, center section of the embodiment of the dual-polarized tapered slot antenna shown in FIG. 5A.
Figure 5C:
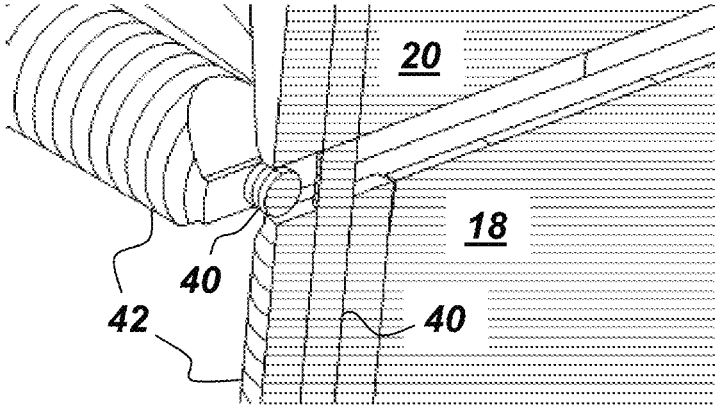

FIG. 5A is a close-up, perspective view of a bottom, center section of the dual-polarized TSA 10. FIGS. 5B and 5C are cross-sectional views of the close-up, perspective view of the bottom, center section of the dual-polarized, quad TSA 10 shown in FIG. 5A.

Figure 6:
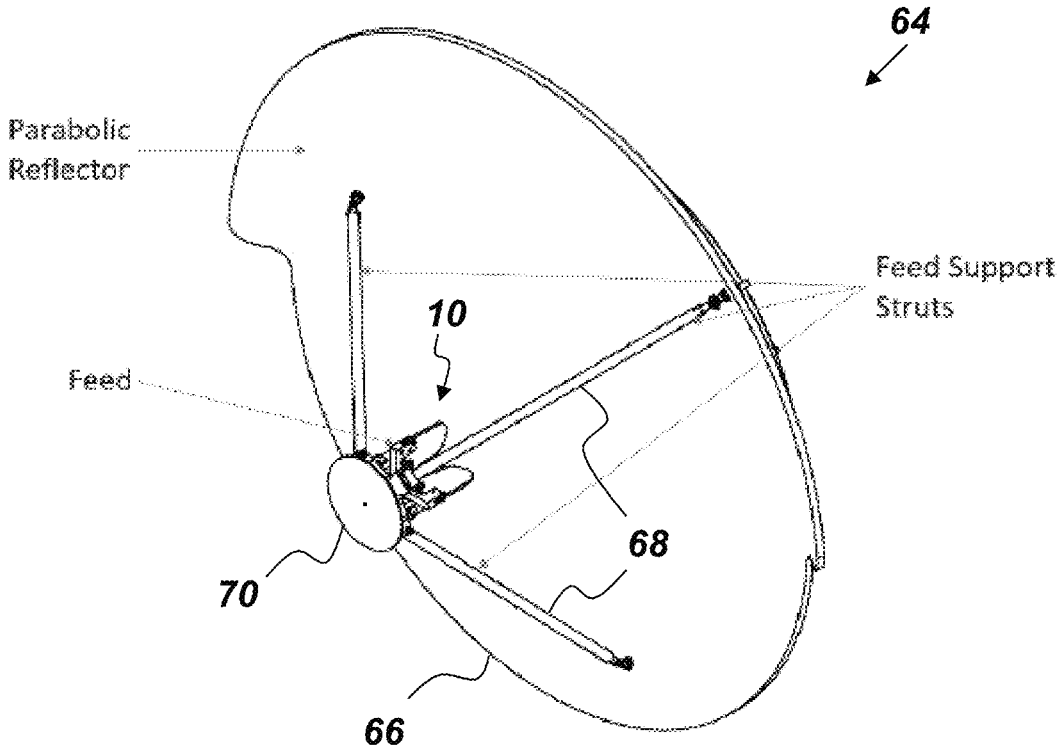
FIG. 6 is a perspective view of an embodiment of a prime focus fed parabolic antenna.

FIG. 6 is a perspective view of a prime focus fed parabolic (PFFP) antenna 64 that uses the dual-polarized TSA 10 as an antenna feed. In this embodiment, a reflector 66 is connected with feed support struts 68 to the dual-polarized TSA 10. The reflector 66 may be a parabolic reflector positioned such that the dual-polarized TSA 10 is approximately in a focal position of the parabolic reflector 66. The PFFP antenna 64 shown in FIG. 6 may be used with high power (i.e., >200 W on each polarization) wideband (i.e., >20:1 bandwidth) transceiver systems with the ability to transmit or receive vertical and horizontal polarizations simultaneously. With an additional feeding circuit, as is known in the art, the dual-polarized TSA 10 can also produce any linear polarization angle, or right hand or left hand circular polarization. The overall gain performance of the PFFP antenna 64 may be determined by the performance of its feed along with how that feed's radiation pattern interacts with the parabolic reflector 66 and support structures 68. The overall voltage standing wave ratio (VSWR) and power handling performance are almost entirely determined by the performance of the antenna's feed. As mentioned above, in this embodiment, the dual-polarized TSA 10 serves as the antenna feed for the PFFP antenna 64. The dual-polarized TSA 10 meets the performance requirements shown in Table 1 below

TABLE 1

Performance Requirements met by the dual-polarized TSA 10.

| Parameter | Performance Requirement |
|---|---|
| Polarization | Two port -vertical and horizontal elements |
| Frequency Range | >20:1 bandwidth |
| Power | 200 W continuous wave (CW) on each port |
| Voltage Standing Wave Ratio (VSWR) | ≤2.3:1 |
| Directivity | Optimized for even dish illumination over frequency range ~30 deg BW |
| Phase Center | Remain relatively stable across frequency range |

The PFFP antenna 64 may further comprise a conductive disk 70 placed approximately 1/4 wavelength (at the lowest intended operating frequency) behind the quad-TSA 10. The conductive disk 70 is electrically insulated from the antenna elements 14, 16, 18, and 20 and is mounted coaxially with the parabolic reflector 66 such that the antenna elements 14, 16, 18, and 20 are disposed between the conductive disk 70 and the parabolic reflector 66. The conductive disk 70 serves as a reflector element that improves the low frequency gain of the dual-polarized TSA 10. In one embodiment, the conductive disk 70 is a flat 15.25-centimeter (6-inch) diameter disk located 7.62 centimeters (3 inches) behind the first and second antenna elements 14, 16, 18, and 20 that adds about 2 dB of forward gain at the lowest frequencies. The conductive disk 70 was found to have negligible effect on higher frequency performance of the PFFP antenna 64.

Figure 7:
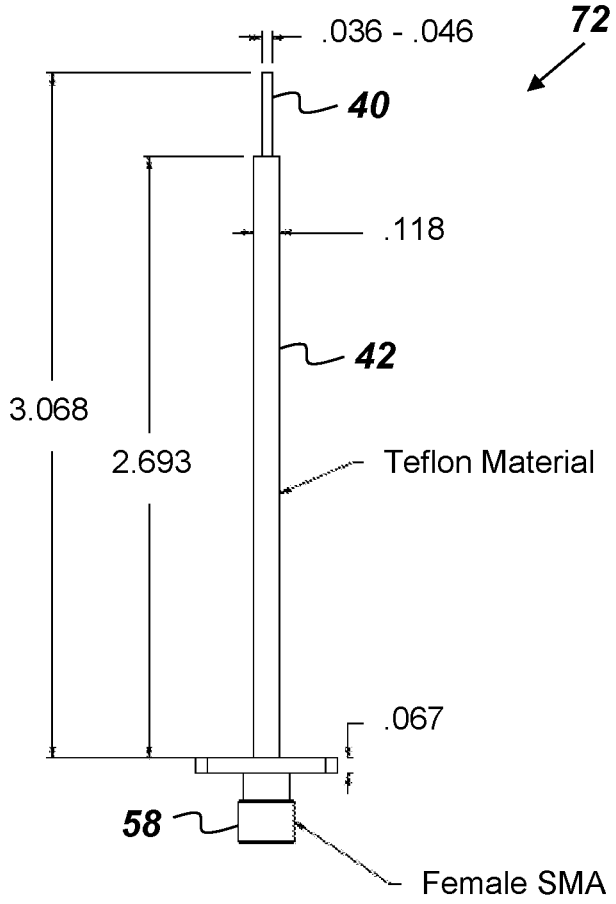
FIG. 7 is a side view of an embodiment of a cable insert that forms part of an embodiment of a balun.

FIG. 7 is a drawing of an embodiment of a cable insert 72 that may form part of each of the baluns 36 and 38. The cable insert 72 comprises the center conductor 40, the dielectric 42, and the connector 58, which may be attached to a coaxial cable. The connector 58 may be attached to the back edge 50 of the first antenna element 14 such that the dielectric 42 and center conductor 40 are routed through the hole 48 in the first element 14. Likewise, another connector 58 may be attached to the back edge of the third antenna element 18 (similar to the back edge 50 of the first antenna element 14) such that the dielectric 42 and center conductor 40 are routed through a hole in the fourth element 18 (similar to the hole 48 in the second element 16).

From the above description of the dual-polarized TSA 10, it is manifest that various techniques may be used for implementing the concepts of the dual-polarized TSA 10 without departing from the scope of the claims. The described embodiments are to be considered in all respects as illustrative and not restrictive. The method/apparatus disclosed herein may be practiced in the absence of any element that is not specifically claimed and/or disclosed herein. It should also be understood that the dual-polarized TSA 10 is not limited to the particular embodiments described herein, but is capable of many embodiments without departing from the scope of the claims.

We claim:

1. A dual-polarized tapered slot antenna (TSA) comprising:

a dielectric bracket;

a first pair of conductive blades mounted to the dielectric bracket so as to define a first tapered slot between edges of the conductive blades of the first pair thereby forming a horizontally-polarized TSA;

a second pair of conductive blades mounted in the dielectric bracket orthogonal to the first pair so as to define a second tapered slot between edges of the conductive blades of the second pair thereby forming a vertically-polarized TSA; and wherein at least part of each of the slot-defining edges of the conductive blades has a thickness that is non-tapered and stepwise-reduced from the thickness of a remainder of the corresponding blade.

2. The dual-polarized TSA of claim 1, wherein at least one of the first tapered slot and the second tapered slots comprises a linear section that transitions to an exponentially-curved section.

3. The dual-polarized TSA of claim 2, wherein the linear section of each of the slot-defining edges is disposed near a feed of the dual-polarized TSA.

4. The dual-polarized TSA of claim 3, wherein the linear sections of the slot-defining edges of the first and second blades are within one degree of being parallel with each other such that a narrowest part of the first tapered slot is closest to the feed, and wherein the linear sections of the slot-defining edges of the third and fourth blades are within one degree of being parallel with each other such that the narrowest part of the second tapered slot is closest to the feed.

5. The dual-polarized TSA of claim 2, wherein a majority of the length of each of the slot-defining edges has a thickness that is non-tapered and stepwise-reduced from the thickness of a remainder of the corresponding blade.

6. The dual-polarized TSA of claim 5, wherein a portion of the non-tapered and stepwise-reduced section of each conductive blade remains non-tapered and stepwise-reduced for approximately 15 millimeters (0.5 inches) as measured perpendicularly from the slot-defining edge.

7. The dual-polarized TSA of claim 1, further comprising a first coaxial balun integrated into a first blade of the first pair of conductive blades and a second coaxial balun integrated into a first blade of the second pair of conductive blades, wherein each of the first and second coaxial baluns comprises:

a center conductor electrically connected to a non-balun-integrated blade; and a dielectric surrounding the center conductor and disposed to electrically insulate the center conductor from the first blade, wherein at a first location on the first blade the dielectric abuts a bottom edge of the first blade and over a length of the integrated balun the first blade gradually surrounds more and more of the dielectric until, at a second location on the first blade, the dielectric is completely surrounded by the first blade so as to gradually transform an unbalanced signal at the second location to a balanced signal that is characteristic of a two-conductor transmission line at the first location.

8. The dual-polarized TSA of claim 7, further comprising a parabolic reflector positioned such that the first and second tapered slots are approximately in a focal position of the parabolic reflector.

9. The dual-polarized TSA of claim 8, further comprising a conductive disk mounted to a back of the dielectric bracket and mounted coaxially with the parabolic reflector such that the first and second pairs of conductive blades are disposed between the conductive disk and the parabolic reflector.

10. The dual-polarized TSA of claim 9, wherein the conductive disk is mounted a distance away from the first and second pairs of conductive blades that is approximately equal to ¼ wavelength of a lowest intended operating frequency of the dual-polarized TSA.

11. The dual-polarized TSA of claim 7, wherein for each of the first and second baluns, a portion of the center conductor is inserted into a receiving hole in the non-balun-integrated blade, and wherein the receiving hole comprises a retainer into which the center conductor is inserted to hold the center conductor in the receiving hole, and wherein a head of the retainer is flush with a surface of the non-balun-integrated blade.

12. The dual-polarized TSA of claim 11, wherein the dielectric bracket further comprises a dielectric support structure disposed to maintain, for each of the first and second baluns, a positional relationship between the dielectric and the first blade.

13. The dual-polarized TSA of claim 12, wherein the dielectrics are cylindrical and wherein an area of contact between the dielectric support structure and each of the dielectrics does not exceed a circular, cross-sectional area of the corresponding dielectric.

14. The dual-polarized TSA of claim 7, wherein each of the first and second pairs of conductive blades further comprises a conductive element electrically connected to both blades in a given pair and positioned so as to span the corresponding tapered slot.

15. The dual-polarized TSA of claim 1, wherein each of first tapered slot and the second tapered slot has a slot width at a narrowest section of approximately 0.8 millimeters (~0.03 inches).

16. A dual-polarized tapered slot antenna (TSA) comprising:

a non-conductive bracket;

first and second antenna elements mounted to the bracket so as to define a first tapered slot between edges of the first and second antenna elements thereby forming a horizontally-polarized TSA;

third and fourth antenna elements mounted to the bracket so as to define a second tapered slot between edges of the third and fourth antenna elements thereby forming a vertically-polarized TSA; and wherein each of the antenna elements comprises a step-wise-reduced-thickness section as compared to a thickness of a remainder of the corresponding antenna element, wherein a terminal edge of the step-wise-reduced-thickness section composes a portion of a corresponding antenna element's slot-defining edge.

17. The dual-polarized TSA of claim 16, wherein the stepwise-reduced-thickness section is also non-tapered.

18. The dual-polarized TSA of claim 16, wherein the first tapered slot and the second tapered slot each comprises a linear section that transitions to an exponentially-curved section.

19. The dual-polarized TSA of claim 18, wherein, for each antenna element, a majority of the slot-defining edge that defines the linear section is composed of the terminal edge of the step-wise-reduced-thickness section.

20. The dual-polarized TSA of claim 16, wherein for at least one of the antenna elements, a portion of the slot-defining edge has the same thickness as the remainder of the corresponding antenna element.

* * * * *